US005898266A

United States Patent [19]

Spindt et al.

[11] Patent Number: 5,898,266

[45] Date of Patent: Apr. 27, 1999

[54] METHOD FOR DISPLAYING FRAME OF PIXEL INFORMATION ON FLAT PANEL DISPLAY

[75] Inventors: Christopher J. Spindt, Menlo Park; David L. Morris, San Jose, both of Calif.

[73] Assignee: Candescent Technologies Corporation, San Jose, Calif.

[21] Appl. No.: 08/683,789

[22] Filed: Jul. 18, 1996

[51] Int. Cl.[6] ..... H01J 19/42; H01J 29/18; H01J 1/62

[52] U.S. Cl. ..... 313/495; 313/422; 313/292

[58] Field of Search ..... 313/495, 496, 313/497, 422, 482, 258, 292, 306, 311; 445/23, 24, 63

[56] References Cited

U.S. PATENT DOCUMENTS

| | | | |
|---|---|---|---|
| 4,745,332 | 5/1988 | Tischer | 313/422 |
| 5,177,410 | 1/1993 | Hashiguchi et al. | 315/366 |
| 5,477,105 | 12/1995 | Curtin et al. | 313/422 |
| 5,528,103 | 6/1996 | Spindt et al. | 313/497 |
| 5,532,548 | 7/1996 | Spindt et al. | 313/422 |
| 5,578,899 | 11/1996 | Haven et al. | 313/422 |
| 5,589,731 | 12/1996 | Fahlen et al. | 313/495 |
| 5,614,781 | 3/1997 | Spindt et al. | 313/422 |
| 5,650,690 | 7/1997 | Haven | 313/422 |
| 5,675,212 | 10/1997 | Schmid et al. | 313/422 |
| 5,686,790 | 11/1997 | Curtin et al. | 313/493 |

*Primary Examiner*—Jay M. Patidar
*Attorney, Agent, or Firm*—Skjerven, Morrill, MacPherson, Franklin & Friel LLP; Ronald J. Meetin

[57] ABSTRACT

A flat panel display (300) having a spacer (351) situated between a faceplate structure (320) and a backplate structure (330) is partitioned into (a) a pair of spacer-adjacent regions (303 and 304) adjacent to, and on opposite sides of, the spacer and (b) a pair of spacer-charging regions (302 and 305) respectively adjacent to, and further away from the spacer than, the spacer-charging regions. Each of the spacer-adjacent and spacer-charging consists of one or more pixel rows. Instead of activating the pixel rows sequentially during a frame of pixel information, the pixel rows are activated according to the order that arises when both of the spacer-charging regions are activated after activating the two spacer-adjacent regions. Operating the display in this manner reduces charge buildup on the spacer.

16 Claims, 15 Drawing Sheets

METHOD FOR DISPLAYING FRAME OF PIXEL INFORMATION ON FLAT PANEL DISPLAY

FIELD OF THE INVENTION

The present invention relates to spacers which are located between a faceplate structure and a backplate structure in a flat panel display. The present invention also relates to methods for operating a flat panel display in conjunction with these spacers.

BACKGROUND OF THE INVENTION

Flat cathode ray tube (CRT) displays include displays which exhibit an large aspect ratio (e.g., 10:1 or greater) with respect to conventional deflected-beam CRT displays, and which display an image in response to electrons striking a light emissive material. The aspect ratio is defined as the diagonal length of the display surface to the display thickness. The electrons which strike the light emissive material can be generated by various devices, such as by field emitter cathodes or thermionic cathodes. As used herein, flat CRT displays are referred to as flat panel displays.

Conventional flat panel displays typically include a faceplate structure and a backplate structure which are joined by connecting walls around the periphery of the faceplate and backplate structures. The resulting enclosure is usually held at a vacuum pressure. To prevent collapse of the flat panel display under the vacuum pressure, a plurality of electrically resistive spacers are typically located between the faceplate and backplate structures at a centrally located active region of the flat panel display.

The faceplate structure includes an insulating faceplate (typically glass) and a light emitting structure formed on an interior surface of the insulating faceplate. The light emitting structure includes light emissive materials, or phosphors, which define the active region of the display. The backplate structure includes an insulating backplate and an electron emitting structure located on an interior surface of the backplate. The electron emitting structure includes a plurality of electron-emitting elements (e.g., field emitters) which are selectively excited to release electrons. The light emitting structure is held at a relatively high positive voltage (e.g., 5 kV) with respect to the electron emitting structure. As a result, the electrons released by the electron-emitting elements are accelerated toward the phosphor of the light emitting structure, causing the phosphor to emit light which is seen by a viewer at the exterior surface of the faceplate (the "viewing surface").

FIG. 1 is a schematic representation of the viewing surface of a flat panel display 100. The faceplate structure 20 of flat panel display 100 includes a light emitting structure which is arranged in a plurality of rows of light emitting elements (i.e., pixel rows), such as pixel rows 1–10. Flat panel display 100 typically includes hundreds of pixel rows, with each row typically including hundreds of pixels. Spacers 101–104 extend horizontally across display 100 in parallel with pixel rows 1–10. Pixel rows 1–10 and spacers 101–104 are greatly enlarged in FIG. 1 for purposes of illustration.

The electron emitting structure of flat panel display 100 is arranged in rows of electron emitting elements which correspond with the pixel rows of faceplate structure 20. All of the electron emitting elements in a given row are simultaneously activated (i.e., fired). In an activated row of electron emitting elements, any electron emitting elements corresponding to pixels that are to be black are, of course, not actually activated even though the row of electron emitting elements is generally described as being activated. With this in mind, the activation of a row of electron emitting elements (or a pixel row) more precisely means that the row is selected to participate in information display. The rows of electron emitting elements are sequentially activated. Thus, the row of electron emitting elements corresponding to pixel row 1 is activated first, followed by the sequential activation of the rows of electron emitting elements corresponding to pixel rows 2–10. The firing order continues in the direction illustrated by arrow 110.

FIG. 2 is a cross sectional view of flat panel display 100 along section line 2—2 of FIG. 1. FIG. 2 illustrates faceplate structure 20, which includes faceplate 21 and light emitting structure 22, backplate structure 30, which includes backplate 31 and electron emitting structure 32, and spacer 101. Light emitting structure 22 includes pixel rows 1–10, and electron emitting structure 32 includes corresponding rows of electron emitting elements 1*a*–10*a*.

As previously described, the rows of electron emitting elements 1*a*–10*a* are sequentially fired at corresponding pixel rows 1–10. When the electrons emitted from the electron emitting elements 1*a*–10*a* strike the light emitting material of pixel rows 1–10, electron scattering occurs. As illustrated for pixel rows 6–9, the scattered electrons can strike spacer 101. The energy of the scattered electrons which strike spacer 101 can be sufficient to free electrons from spacer 101, thereby positively charging the surface of spacer 101. Spacer 101 is rapidly charged as the rows of electron emitting elements approaching spacer 101 are sequentially activated.

When the row (or rows) of electron emitting elements which are located immediately adjacent to spacer 101 (e.g., electron emitting element 10*a*) are activated, the positive charge which has built up on spacer 101 can be sufficient to deflect the emitted electrons toward spacer 101. As a result, the pixel rows immediately adjacent to spacer 101 (e.g., pixel row 10) may only receive a fraction of the electrons emitted from their corresponding rows of electron emitting elements, thereby causing these pixel rows to appear dark. Even slight deflection of the emitted electrons can result in perceivable pixel distortion adjacent to spacer 101. That is, electrons emitted from electron emitting element 10*a* can be deflected and strike pixel row 10 at a position which is off-center within pixel row 10, thereby causing distortion in pixel row 10. For these reasons, the viewer may perceive distorted (e.g., dark or light) pixel lines adjacent to spacer 101.

Prior art spacers have included electrically resistive coatings which help to bleed off the charge which is built up on the spacer surfaces. However, such resistive coatings, by themselves, can be insufficient to reduce the charging of the spacer surfaces to an acceptable level.

It would therefore be desirable to have methods and/or structures which reduce the charging of the spacer surfaces to an acceptable level during operation of flat panel display 100.

SUMMARY

Accordingly, one embodiment of the invention includes the steps of logically partitioning a flat panel display into three display regions: spacer-adjacent regions, which are located immediately adjacent to the spacers, (2) spacer-charging regions, which are located adjacent to the spacer adjacent regions, and (3) spacer-neutral regions, which are located adjacent to the spacer-charging regions. The spacer-charging regions include those regions of the flat panel display which, when activated, charge an adjacent spacer to an undesirably high level. The spacer-neutral regions are those regions of the flat panel display which, when activated, do not significantly charge the spacers. To prevent the spacers from being charged when the spacer-adjacent regions are activated, the spacer-adjacent regions are activated before the spacer-charging regions. A typical operating sequence includes the steps of activating the spacer-neutral regions, activating the spacer-adjacent regions, and then activating the spacer-charging regions. Because the spacers are not excessively charged when the spacer-adjacent regions are activated, the spacer-adjacent regions operate properly (i.e., without significant electron deflection), and no dark lines are perceived adjacent to the spacers.

In another embodiment, spacers are made of a material having a high dielectric constant, thereby increasing the charging time constant of the spacers and preventing rapid charge build up on the spacers. In a particular embodiment, the spacers are made of titanium oxide and chromium oxide dispersed in aluminum oxide. The concentration of titanium oxide is controlled to be approximately four percent. By controlling the percentage of titanium oxide to be approximately four percent, the dielectric constant of the spacer material is advantageously maximized. The concentration of chromium oxide and aluminum oxide can be, for example, 64 percent and 32 percent, respectively.

In another embodiment, a face electrode is located on an outer surface of each spacer and a common bus structure connects the face electrodes. The common bus structure advantageously distributes the charge built up on any particular spacer among all of the spacers. In one variation, the common bus structure is formed by an insulating strip located on the faceplate of the flat panel display, adjacent to the light emitting structure, and a conductive bus layer located on the insulating strip. The conductive bus layer is connected to each of the face electrodes.

In another embodiment, a capacitor is coupled to the common bus structure, thereby increasing the charging time constant of the spacers. The capacitor can be physically located inside or outside of the flat panel display. Moreover, the capacitor can be connected to a high voltage supply or a ground voltage supply.

The capacitor can be formed within the flat panel display by including a conductive plate between the faceplate and the insulating strip of the common bus structure. The conductive plate and the conductive bus layer form the plates of the capacitor, and the insulating strip forms the dielectric of the capacitor. The conductive plate can be connected to a high voltage supply through the light emitting structure of the faceplate structure.

In yet another embodiment, a flat panel display includes a plurality of parallel pixel rows and a plurality of spacers which extend perpendicular to the pixel rows. Each spacer includes a face electrode which distributes excessive charges along the length of the spacer, thereby preventing charge build-up on the spacer.

The present invention will be more fully understood in view of the following detailed description taken together with the drawings.

DETAILED DESCRIPTION

The following definitions are used in the description below. Herein, the term "electrically insulating" (or "dielectric") generally applies to materials having a resistivity greater than $10^{12}$ ohm-cm. The term "electrically non-insulating" thus refers to materials having a resistivity below $10^{12}$ ohm-cm. Electrically non-insulating materials are divided into (a) electrically conductive materials for which the resistivity is less than 1 ohm-cm and (b) electrically resistive materials for which the resistivity is in the range of 1 ohm-cm to $10^{12}$ ohm-cm. These categories are determined at low electric fields.

Examples of electrically conductive materials (or electrical conductors) are metals, metal-semiconductor compounds, and metal-semiconductor eutectics. Electrically conductive materials also include semiconductors doped (n-type or p-type) to a moderate or high level. Electrically resistive materials include intrinsic and lightly doped (n-type or p-type) semiconductors. Further examples of electrically resistive materials are cermet (ceramic with embedded metal particles) and other such metal-insulator composites. Electrically resistive materials also include conductive ceramics and filled glasses.

First Embodiment

Figure 1:
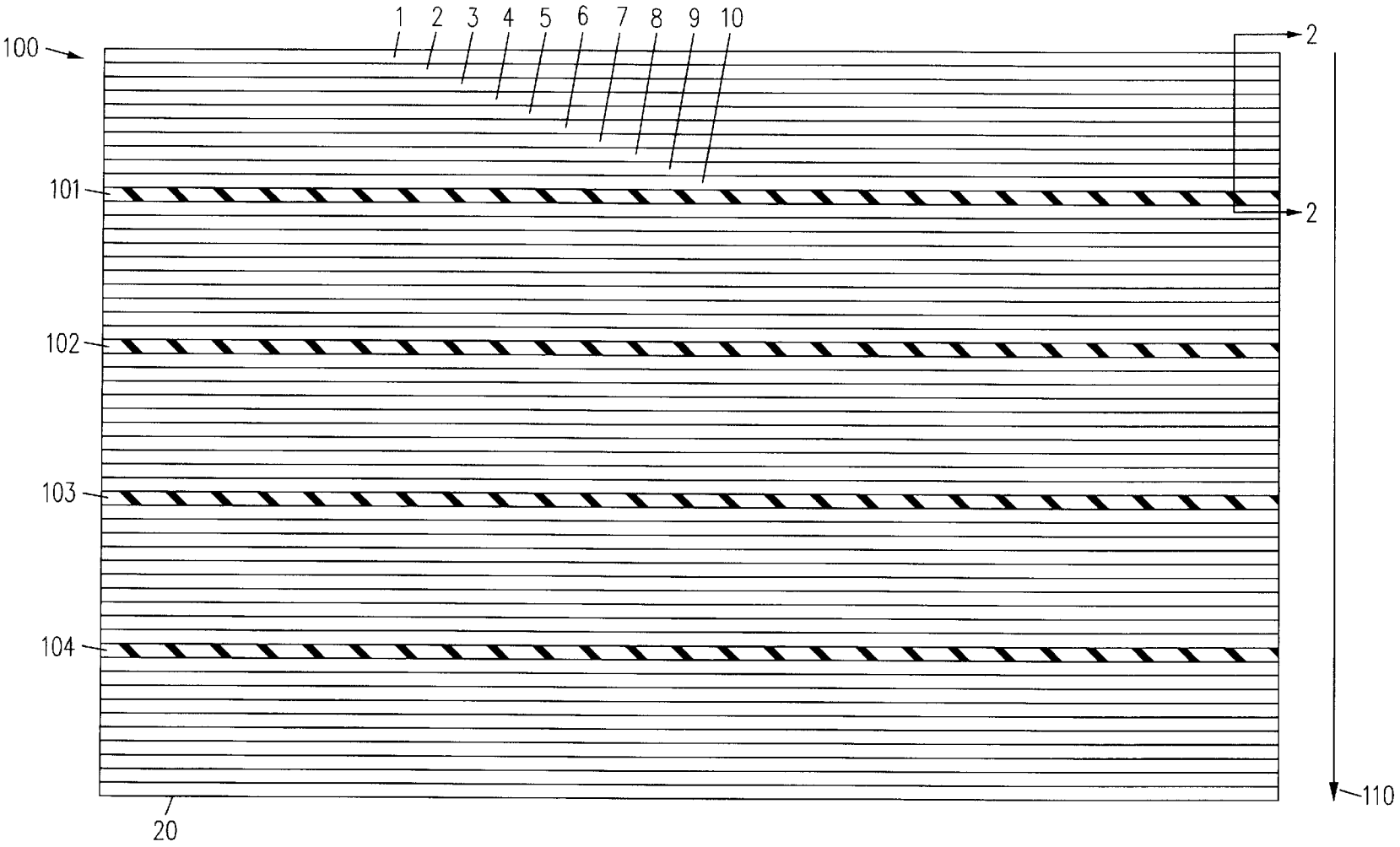
(PRIOR ART) FIG. 1
FIG. 1 is a schematic representation of the viewing surface of a conventional flat panel display.
Figure 2:
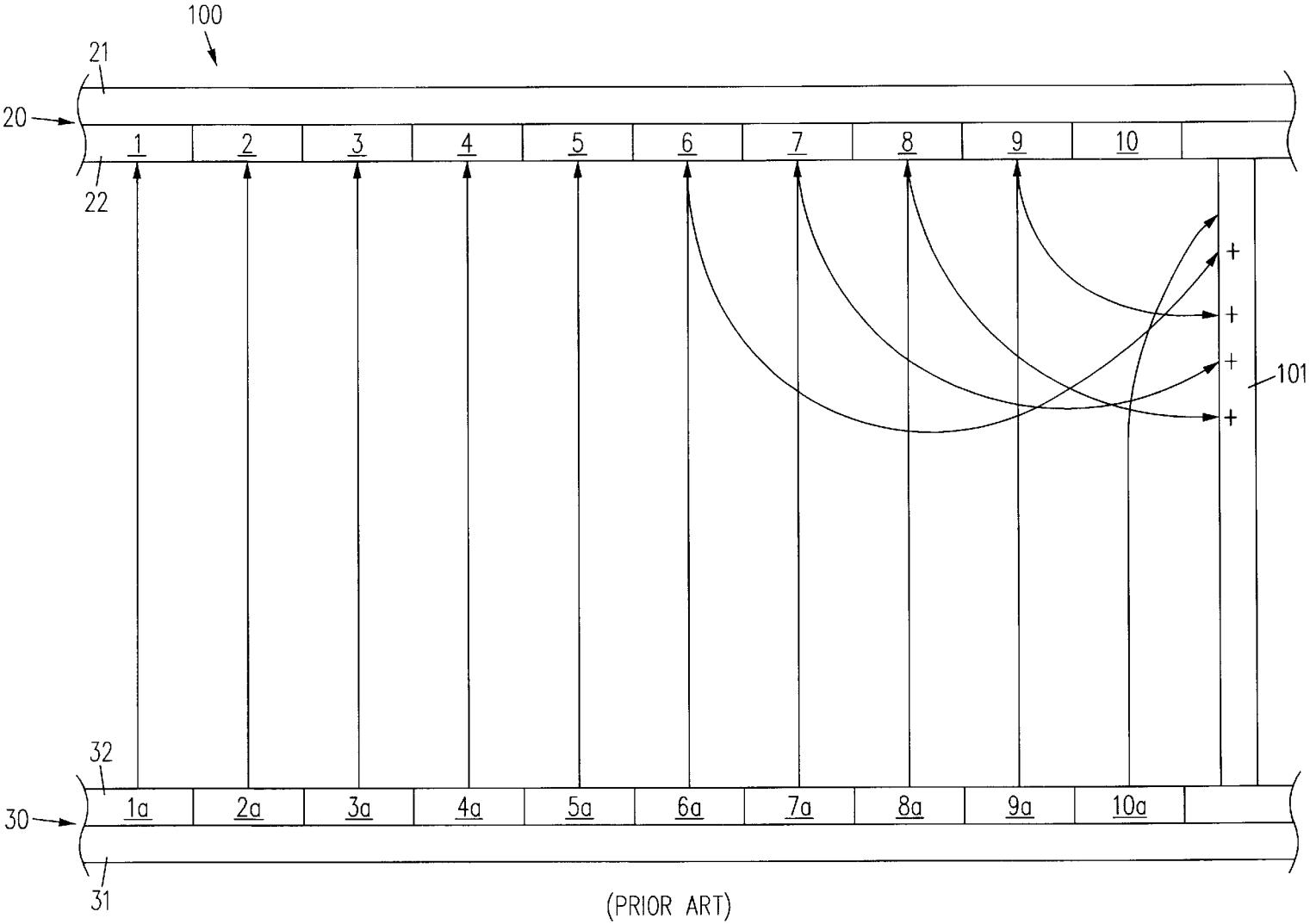
(PRIOR ART) FIG. 2
FIG. 2 is a cross sectional view of the flat panel display of FIG. 1 along section line 2—2 of FIG. 1.
Figure 3:
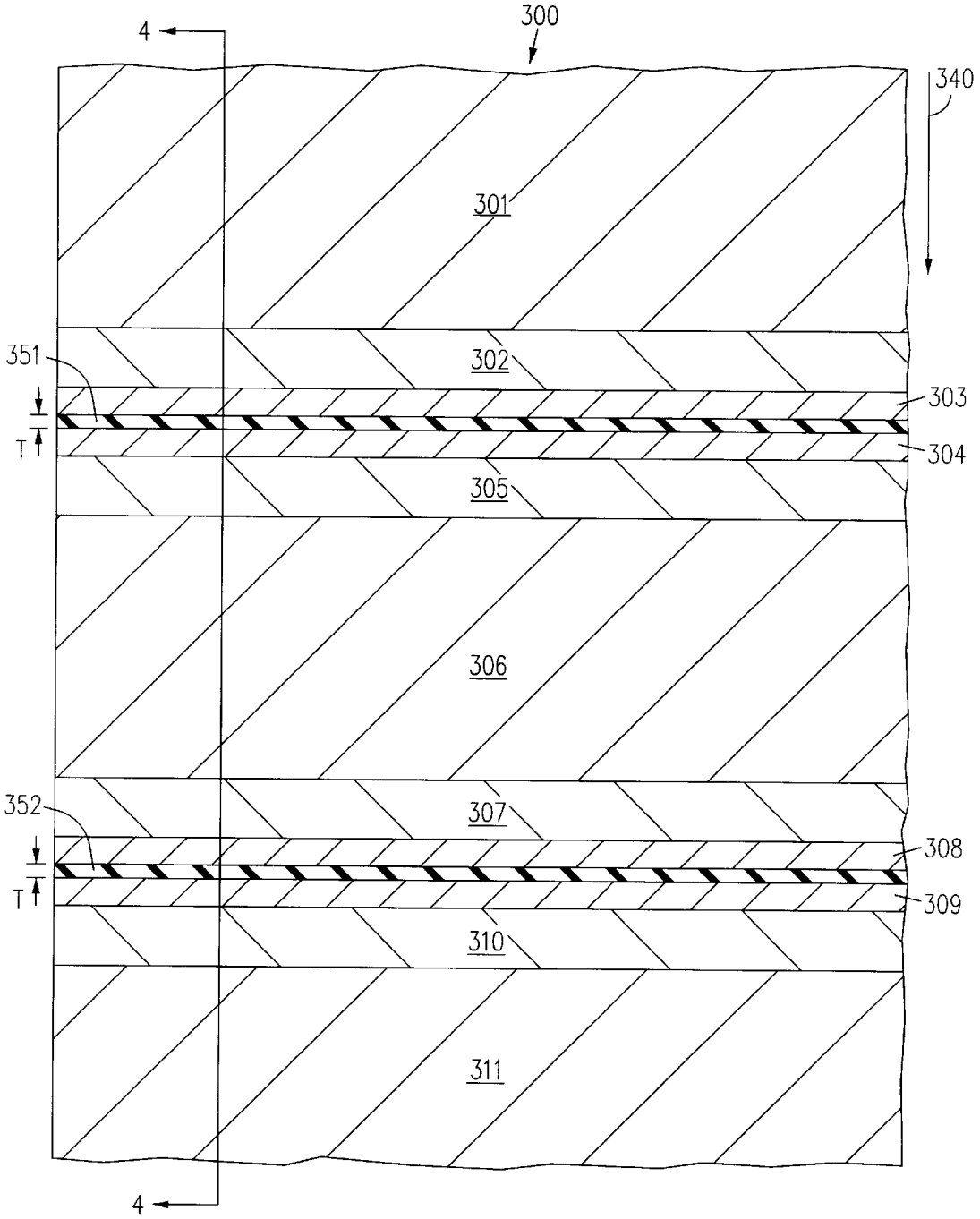
FIG. 3 is a schematic representation of a portion of a viewing surface of a flat panel display in accordance with one embodiment of the invention.
Figure 4:
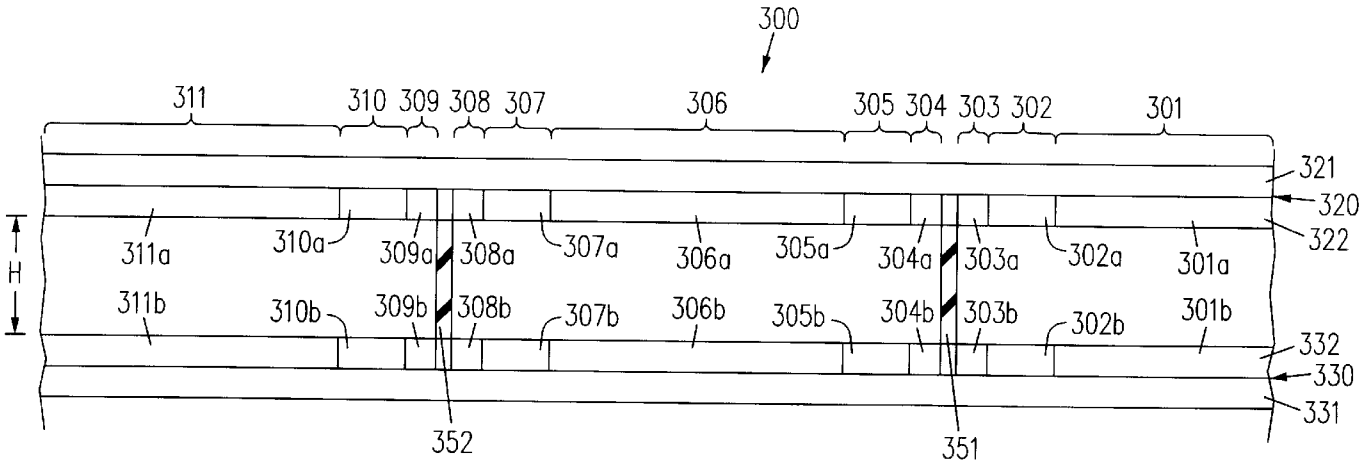
FIG. 4 is a cross sectional view of the flat panel display of FIG. 3 along section line 4—4 of FIG. 3.

FIG. 3 illustrates a portion of the viewing surface of a flat panel display 300 in accordance with one embodiment of the invention. FIG. 4 is a cross sectional view of flat panel display 300 along section line 4—4 of FIG. 3. The illustrated portion of flat panel display 300 includes faceplate structure 320, backplate structure 330 and spacers 351 and 352. Faceplate structure 320 is a conventional structure which includes an electrically insulating glass faceplate 321 and a light emitting structure 322. Backplate structure 330 is also a conventional structure, and includes electrically insulating backplate 331 and electron emitting structure 332. Faceplate structure 320 and backplate structure 330 are described in more detail in commonly owned U.S. Pat. No. 5,477,105; U.S. patent application Ser. No. 08/081,913 "Flat Panel Display with Ceramic Backplate" by Curtin et al., filed Jun. 22, 1993, now U.S. Pat. No. 5,686,790; and PCT Publication No. WO 95/07543, published Mar. 16, 1995, which are hereby incorporated by reference in their entirety.

In one variation, each of spacers 351 and 352 is formed from a solid piece of uniform electrically resistive material such as a ceramic containing a transition metal oxide. Each of spacers 351 and 352 can also be formed from an electrically insulating core having electrically resistive skins formed on the outside surfaces thereof. Spacers 351 and 352 are described in more detail in Schmid et al U.S. patent application Ser. No. 08/414,408 filed Mar. 31, 1995, now U.S. Pat. No. 5,675,212; and Spindt U.S. patent application Ser. No. 08/505,841 filed Jul. 20, 1995, now U.S. Pat. No. 5,674,781 both of which are hereby incorporated by reference in their entirety.

The illustrated portion of flat panel display 300 is logically partitioned into eleven display regions 301–311. Each of display regions 301–311 includes a corresponding light emitting region 301*a*–311*a* of light emitting structure 322, and a corresponding electron emitting region 301*b*–311*b* of electron emitting structure 332. Each of light emitting regions 301*a*–311*a* includes one or more rows of light emitting elements (i.e., pixel rows) which extend in parallel with spacers 351 and 352. Similarly, each of electron emitting regions 301*b*–311*b* includes one or more rows of electron emitting elements. Each of light emitting regions 301*a*–311*a* has a corresponding electron emitting region 301*b*–311*b*.

In the described embodiment, the pixels of flat panel display 300 have a pitch (spacing) of 12.5 mils, although other pitches are possible and considered to be within the scope of the invention. Spacers 351 and 352 extend parallel to each other with a lateral spacing of 375 mils. Thus, thirty pixel rows exist between spacers 351 and 352. Other spacers (not shown) of flat panel display 300 are identically spaced. Flat panel display 300 can include, for example, 480 pixel rows. Spacers 351 and 352 have a thickness T of approximately 2.25 mils, and a height H of approximately 50 mils. As a result, the spacing between faceplate structure 320 and backplate structure 330 is approximately 50 mils. A voltage difference of approximately 5 kV is maintained between electron emitting structure 332 and light emitting structure 322.

Display regions 303 and 304 are located immediately adjacent to spacer 351, and display regions 308 and 309 are immediately adjacent to spacer 352. Display regions 303, 304, 308 and 309 are therefore hereinafter referred to as spacer-adjacent regions. Spacer-adjacent regions 303, 304, 308 and 309 are selected to include the pixel rows which would fail to receive an acceptable number of emitted electrons from their corresponding rows of electron emitting elements as a result of charge build up on spacers 351 and 352, assuming that the rows of electron emitting elements were sequentially activated in the direction of arrow 340. Spacer-adjacent regions 303, 304, 308 and 309 are also selected to include the pixel rows which would receive electrons which are deflected by an amount which results in pixel distortion as a result of charge built up on spacers 351 and 352, assuming that the rows of electron emitting elements were sequentially activated in the direction of arrow 340.

In the described embodiment, each of spacer-adjacent regions 303, 304, 308 and 309 includes one or two pixel rows which are located immediately adjacent to spacers 351–352. If, for example, each of spacer-adjacent regions 303, 304, 308 and 309 includes two pixel rows, then light emitting regions 303*a*, 304*a*, 308*a* and 309*a* would each include two rows of light emitting elements, and corresponding electron emitting regions 303*b*, 304*b*, 308*b* and 309*b* would each include two corresponding rows of electron emitting elements.

When electron emitting regions 303*b*, 304*b*, 308*b* and 309*b* are activated, electrons scattering from the corresponding light emitting regions 303*a*, 304*a*, 308*a* and 309*a* do not significantly charge spacers 351 and 352. This is because the electrons which scatter from light emitting regions 303*a*, 304*a*, 308*a* and 309*a* tend to hit spacers 351 and 352 relatively close to the top of spacers 351 and 352 (i.e., near light emitting structure 322). As a result, the charge introduced by these electrons is easily bled off to light emitting structure 322.

Display regions 302, 305, 307 and 310 are located immediately adjacent to spacer-adjacent regions 303, 304, 308 and 309, respectively. Display regions 302, 305, 307 and 310 are selected to include the pixel rows which, when sequentially fired upon by their corresponding rows of electron emitting elements, provide electron scattering which charges spacers 351 and 352 to an undesirably high level. Regions 302, 305, 307 and 310 are hereinafter referred to as spacer-charging regions. Spacer charging regions 302, 305, 307 and 310 include corresponding light emitting regions 302*a*, 305*a*, 307*a* and 310*a*, and corresponding electron emitting regions 302*b*, 305*b*, 307*b* and 310*b*. In the described embodiment, each of spacer-charging regions 302, 305, 307 and 310 includes three to five pixel rows which are located immediately adjacent to the corresponding spacer-adjacent regions 303, 304, 308 and 309. If, for example, each of spacer-adjacent regions 303, 304, 308 and 309 includes five pixel rows, then light emitting regions 302*a*, 305*a*, 307*a* and 310*a* would each include five rows of light emitting elements, and corresponding electron emitting regions 302*b*, 305*b*, 307*b* and 310*b* would each include five corresponding rows of electron emitting elements.

In a particular embodiment, the pixel rows included in spacer-charging regions 302, 305, 307 and 310 are those pixel rows which are spaced apart from spacers 351 and 352 by a distance in the range of approximately 0.5 to 1.5 times the distance between light emitting structure 322 and electron emitting structure 332.

Display region 301 is located immediately adjacent to spacer-charging region 302, display region 306 is located between spacer-charging regions 305 and 307, and display region 311 is located immediately adjacent to spacer-charging region 310. Display regions 301, 306 and 311 are selected to include the pixel rows which, when fired upon by their corresponding rows of electron emitting elements, do not scatter electrons in a manner which significantly charges spacers 351 and 352. That is, when the pixel rows in display regions 301, 306 and 311 are fired upon, the electrons which scatter from corresponding light emitting regions 301*a*, 306*a* and 311*a* either fail to reach spacers 351 and 352, or fail to significantly charge spacers 351 and 352 upon reaching these spacers. Regions 301, 306 and 311 are hereinafter referred to as spacer-neutral regions.

In the described embodiment, each of spacer-neutral regions 301, 306 and 311 is laterally separated from spacers 351 and 352 by approximately 5 to 7 pixel rows. Thus, each of spacer-neutral regions 301, 306 and 311 includes 16 to 22 pixel rows which are located immediately adjacent to the corresponding spacer-charging regions 302, 305, 307 and 310. If, for example, each of spacer-neutral regions 301, 306 and 311 includes 16 pixel rows, then light emitting regions 301*a*, 306*a*, and 311*a* would each include sixteen rows of light emitting elements, and corresponding electron emitting regions 301*b*, 306*b* and 311*b* would each include sixteen corresponding rows of electron emitting elements.

In a particular embodiment, the pixel rows included in spacer-neutral regions 301, 306 and 311 are those pixel rows which are spaced apart from spacers 351 and 352 by a distance which is greater than 1.5 times the distance between light emitting structure 322 and electron emitting structure 332.

In accordance with one embodiment of the invention, electron emitting regions 301*b*–311*b* are activated in the order described below. Within each of electron emitting regions 301*b*–311*b*, the rows of electron emitting elements are sequentially activated in the direction indicated by arrow 340 (FIG. 3). The activation order is controlled by a row addressing system of flat panel display 300.

First, the electron emitting elements of electron emitting region 301*b* are sequentially activated within spacer-neutral region 301. As previously described, the activation of electron emitting region 301*b* does not excessively charge spacer 351. Next, the electron emitting elements of electron emitting regions 303*b* and 304*b* are sequentially activated within spacer-adjacent regions 303 and 304. Because spacer 351 is not excessively charged at the time that electron emitting regions 303*b* and 304*b* are activated, the electrons emitted from these regions 303*b* and 304*b* pass to corresponding light emitting regions 303*a* and 304*b* without significant deflection due to charging of spacer 351. In a particular embodiment, electron emitting region 303*b* is activated before electron emitting region 304*b*.

Next, the electron emitting elements of electron emitting regions 302*b* and 305*b* are sequentially activated within spacer-charging regions 302 and 305. In a particular embodiment, electron emitting region 302*b* is activated before electron emitting region 305*b*. Although the activation of electron emitting regions 302*b* and 305*b* causes charge to build up on spacer 351, this charge is dissipated by the time that the electron emitting regions 303*b* and 304*b* of spacer-adjacent regions 303 and 304 are subsequently activated. For example, assuming that flat panel display 300 has a refresh frequency of 70 Hz, spacer 351 has approximately 14.3 milliseconds in which to discharge before the time that electron emitting regions 303*b* and 304*b* are subsequently activated.

The electron emitting elements of electron emitting region 306*b* are then sequentially activated within spacer-neutral region 306. As previously described, the activation of electron emitting region 306*b* does not excessively charge spacer 351 or 352. Next, the electron emitting elements of electron emitting regions 308*b* and 309*b* are sequentially activated within spacer-adjacent regions 308 and 309. Because spacer 352 is not excessively charged at the time that electron emitting regions 308*b* and 309*b* are activated, the electrons emitted from these regions 308*b* and 309*b* pass to corresponding light emitting regions 308*a* and 309*b* without significant deflection due to charging of spacer 352.

Next, the electron emitting elements of electron emitting regions 307*b* and 310*b* are sequentially activated within spacer-charging regions 307 and 310. Again, the charge built up on spacer 351 in response to the activation of electron emitting regions 307*b* and 310*b* is dissipated by the time that electron emitting regions 308*b* and 309*b* are subsequently activated. The electron emitting elements of electron emitting region 311*b* are then sequentially activated within spacer-neutral region 311.

The activation of other electron emitting regions (not shown) of flat panel display 300 continues in the manner previously described for electron emitting regions 301*b*–311*b*. Eventually, the activation order returns to electron emitting region 301*b* of spacer-neutral region 301 and the previously described order is repeated. Again, by the time that electron emitting regions 303*b*–304*b* and 308*b*–309*b* of spacer-adjacent regions 303–304 and 308–309 are activated for the second time, the charge on spacers 351 and 352 have had sufficient time to dissipate.

Because the electrons emitted from electron emitting regions 303*b*, 304*b*, 308*b* and 309*b* are routed to corresponding light emitting regions 303*a*, 304*a*, 308*a* and 309*a* without substantial deflection, the image displayed at the viewing surface of faceplate 321 advantageously does not exhibit dark lines adjacent to spacers 351 and 352.

Electron emitting regions 301*b*–311*b* can be fired in other sequences and still fall within the scope of the invention. However, the electron emitting regions 303*b*, 304*b*, 308*b* and 309*b* of spacer-adjacent regions 303, 304, 308 and 309 should not be activated immediately after the activation of the electron emitting regions 302*b*, 305*b*, 307*b* and 310*b* of spacer-charging regions 302, 305, 307 and 310.

Second Embodiment

In accordance with another embodiment of the invention, spacers 351 and 352 are fabricated such that these spacers exhibit a relatively high dielectric constant. A high dielectric constant is defined as being greater $100\epsilon_0$, where $\epsilon_0$ is equal to $8.85\times10^{-12}$ farads/meter. A high dielectric constant can further be defined as being in the range of $400\epsilon_0$ to $800\epsilon_0$. As a result of the high dielectric constant of the spacers, the charging time constant associated with spacers 351 and 352 is increased, thereby preventing rapid charging of these spacers. By preventing rapid charge build-up on spacers 351 and 352, the deflection of electrons emitted by electron emitting regions 303*b*, 304*b*, 308*b* and 309*b* of spacer-adjacent regions 303, 304, 308 and 309 is minimized. In accordance with one variation of this embodiment, the rows of electron emitting elements of flat panel display 300 are activated in the manner described above in connection with the first embodiment. Alternatively, the rows of the electron emitting elements of flat panel display 300 can be activated sequentially.

In accordance with one variation of the present embodiment, high-dielectric constant spacers are fabricated to include titanium oxide ($TiO_2$), aluminum oxide ($Al_2O_3$) and chromium oxide ($Cr_2O_3$) in the percentages listed below in Table 1.

TABLE 1

Titanium Oxide=4.0%

Aluminum Oxide=32.0%

Chromium Oxide=64.0%

By maintaining the percentage of titanium oxide at or about 4 percent, the dielectric constant of the spacer is maintained at a relatively high level. A spacer having the composition listed above in Table 1 is hereinafter referred to as a "4/32/64" spacer. A 4/32/64 spacer exhibits a dielectric constant of approximately $700\epsilon_0$ to $750\epsilon_0$ at a frequency of 1200 to 1500 Hz. In comparison, a spacer having a composition of only 1.6% titanium oxide, 34.4% aluminum oxide and 64.0% chromium oxide exhibits a dielectric constant of approximately $10\epsilon_0$ or $11\epsilon_0$ at 100 Hz. Thus, by controlling the percentage of titanium oxide to be approximately 4 percent, a significant increase in the dielectric constant of spacers 351 and 352 is realized.

In addition, the 4/32/64 spacer advantageously exhibits other properties which are considered advantageous in a flat panel display environment. More specifically, the 4/32/64 spacer exhibits a relatively high sheet resistance of approximately $7\times10^8$ ohms/square. Thus, by holding the percentage of titanium oxide at approximately 4 percent, the spacer is maintained within an acceptable range of electrical resistivity. In addition, the 4/32/64 spacer exhibits a secondary emission ratio in the range of 1 to 2.2 at voltages between 1 kV and 4 kV.

In one variation of the present embodiment, the 4/32/64 spacer is fabricated from a slurry created by mixing ceramic powders, organic binders and a solvent in a conventional ball mill. Table 2 sets forth a formula for such a slurry.

TABLE 2

| | | |
|---|---|---|
| Aluminum oxide powder | 103.7 | grams |
| Chromium oxide powder | 207.3 | grams |
| Titanium oxide powder | 12.9 | grams |
| Butvar B76 | 34 | grams |
| Santicizer 150 | 10 | grams |
| Kellox Z3 Menahden oil | 0.65 | gram |
| Ethanol | 105 | grams |
| Toluene | 127 | grams |

In other variations, the ceramic formula also contains modifiers chosen to control grain size or aid sintering. Compounds such as silicon dioxide, magnesium oxide, and calcium oxide can be used as modifiers.

Using conventional methods, the milled slurry is used to cast a tape having a thickness of 60–120 $\mu$m. In one variation, this tape is cut into large wafers which are 10 cm wide by 15 cm long. The wafers are then loaded onto a flat conventional setter and fired in air and/or a reducing atmosphere until the wafers exhibit the desired resistivity.

In particular, the wafers are typically fired in a cold wall periodic kiln using a hydrogen atmosphere with a typical dew point of 24° C. If the organic components of the wafer are to be pyrolized (i.e., removed) by the action of heat in the same kiln, the dew point of the hydrogen atmosphere will be higher (approximately 50° C.) to facilitate removal of the organics without damaging the wafers. The dewpoint will be shifted from the higher dew point (50° C.) to the lower dewpoint (24° C.) after the organic components of the wafer are pyrolized. Pyrolysis is typically complete at a temperature of 600° C. Typically, the wafers are fired at a peak temperature of 1500° C. for 1–2 hours. The properties of the ceramic composition are controlled by the detailed firing profile. Depending on the starting raw materials, and on the exact combination of strength, resistivity, and secondary electron emission desired in the spacer, the actual peak temperature may be between 1450° C. and 1750° C., and the firing profile may maintain this peak temperature from 1 to 5 hours. The wafers are then unloaded, inspected and cut into strips which are used as spacers 351 and 352. In one variation, these strips are approximately 2.25 mils thick, 2 inches long, and 50 mils tall.

In addition to controlling the electrical resistivity of the spacers by varying the percentage of titanium oxide, the electrical resistivity of the spacers can also be controlled by controlling the percentage of chromium oxide. By increasing the percentage of chromium oxide, the electrical conductivity of the spacer can be increased. However, increasing the percentage of chromium oxide also increases the required sintering temperature of the spacer material. The electrical resistivity can also be controlled by controlling the partial pressure of oxygen in the furnace during firing or by changing the dewpoint in the furnace by modifying the $H_2$ to $O_2$ ratio.

Third Embodiment

Figure 5:
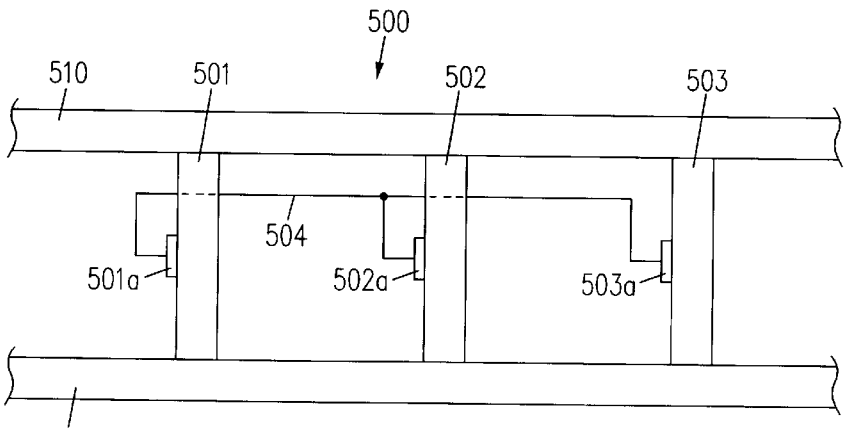
FIG. 5 is a schematic representation of a flat panel display having a common spacer bus in accordance with another embodiment of the present invention.

FIG. 5 is a schematic diagram of a flat panel display 500 in accordance with another embodiment of the present invention. The present embodiment can be used in combination with the previously described second embodiment, or independent of the second embodiment. In flat panel display 500, a plurality of spacers, such as spacers 501–503, are connected between a faceplate structure 510 and a backplate structure 511. Each of spacers 501–503 additionally includes a corresponding face electrode 501*a*–503*a* which is connected to a common bus 504. Each of face electrodes 501*a*–503*a* is located on an outer surface of its corresponding spacer 501–503 at a location between the faceplate structure 510 and the backplate structure 511. Common bus 504 effectively combines the resistances and capacitances of spacers 501–503. Common bus 504 also distributes charge among all of spacers 501–503. For example, when a spacer-charging region adjacent to spacer 501 is activated, the resulting charge will be distributed among spacers 501, 502 and 503 by common bus 504. This advantageously reduces the charge built up on spacer 501 (compared to the charge which would have been built up on spacer 501 in the absence of common bus 504). Although the charge built up on spacers 502 and 503 is increased at this time (compared to the charges which would have been built up on spacers 502 and 503 in the absence of common bus 504), such an increase is acceptable, since the spacer-adjacent regions corresponding to spacers 502 and 503 are not activated until some future time.

Figure 6:
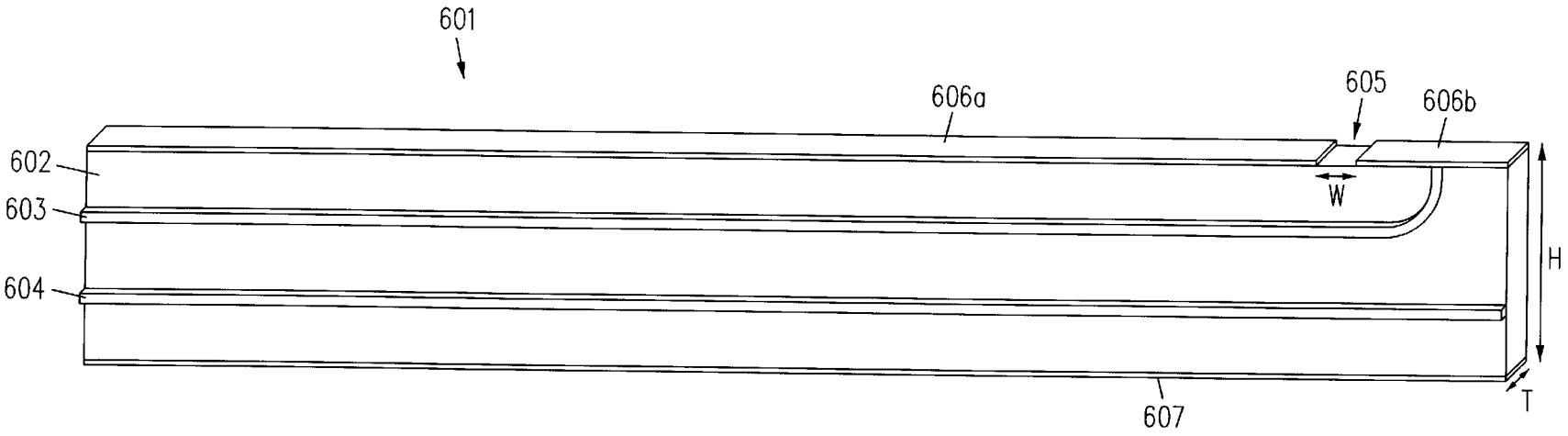
FIG. 6 is an isometric view of a spacer which is used in several embodiments of the invention.

FIG. 6 is an isometric view of a spacer 601 which can be used in the present embodiment. Spacer 601 includes a spacer body 602, face electrodes 603–604, and edge electrodes 606*a*, 606*b* and 607. In one variation, spacer body 602 is made of the 4/32/64 spacer material previously described in the second embodiment. Alternatively, spacer body 602 is made of another conventional spacer material, including, but not limited to, a solid piece of uniform electrically resistive material such as a ceramic containing a transition metal oxide, or an electrically insulating core having electrically resistive skins. Face electrodes 603 and 604, and edge electrodes 606*a*, 606*b* and 607 are made of an electrically conductive material such as aluminum or copper. The fabrication of face electrodes 603 and edge electrodes 606*a*, 606*b* and 607 is described in more detail in U.S. patent application Ser. No. 08/414,408, cited above.

Face electrodes 603 and 604 and edge electrodes 606*a*, 606*b* and 607 control the voltage distribution along spacer 601. Because spacer 601 has a thickness T of approximately 2.25 mils, which is relatively small compared to its height H of 50 mils, face electrodes 603 and 604 are only required on one surface of spacer body 602 to control the voltage distribution throughout spacer 601.

A gap 605 exists between edge electrodes 606*a* and 606*b*. The dimensions of gap 605 are selected such that edge electrode 606*a* is electrically isolated from edge electrode 606*b*. In a particular embodiment, gap 605 has a width W of approximately 50 mils. As described in more detail below, edge electrode 606*a* provides an electrical connection to the light emitting structure of a flat panel display, edge electrode 606*b* provides an electrical connection between face electrode 603 and a common bus, and edge electrode 607 provides an electrical connection to the electron emitting structure of a flat panel display.

Figure 7:
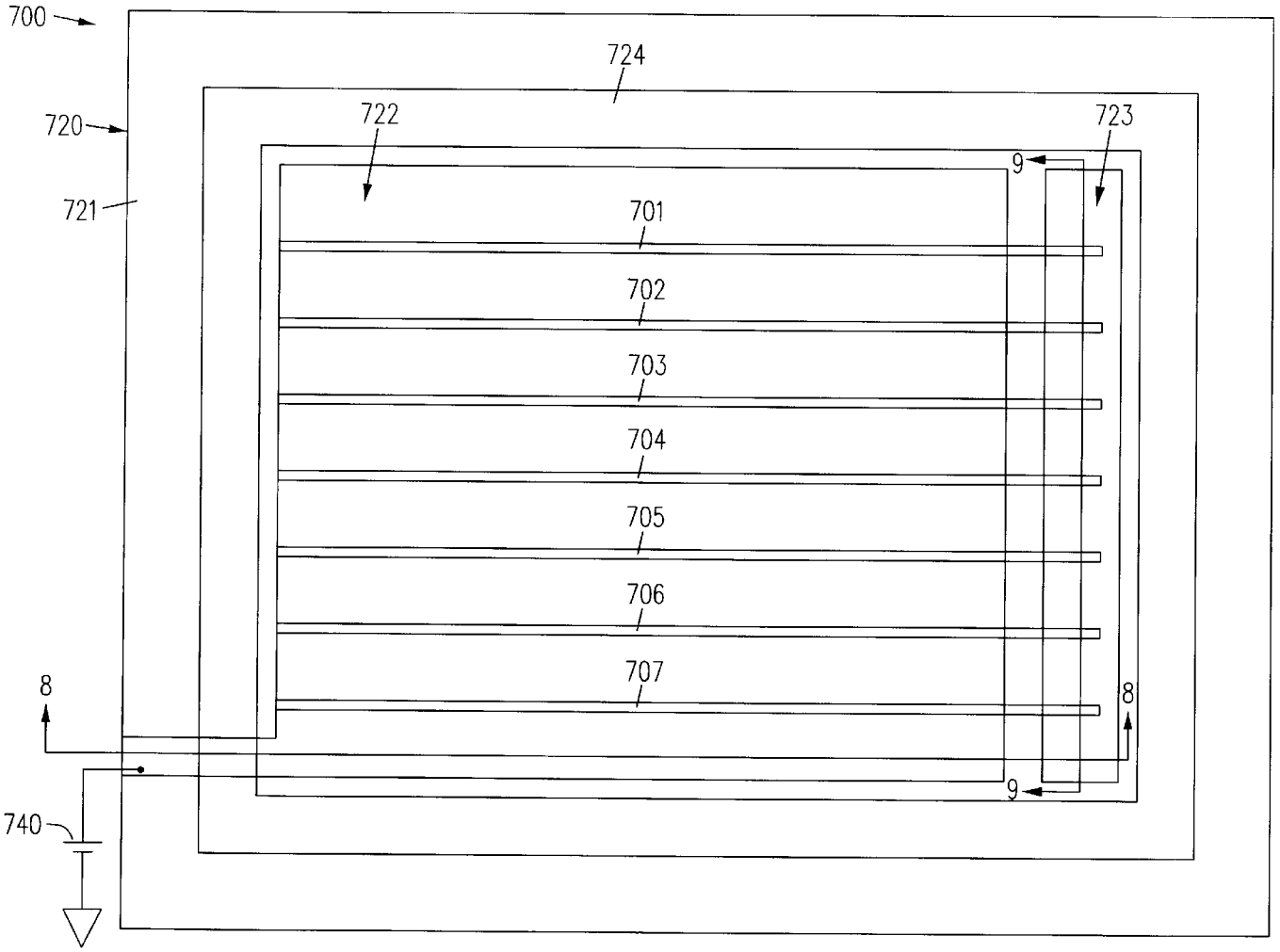
FIG. 7 is a schematic representation of the upper surface of a flat panel display having a common spacer bus.
Figure 8:
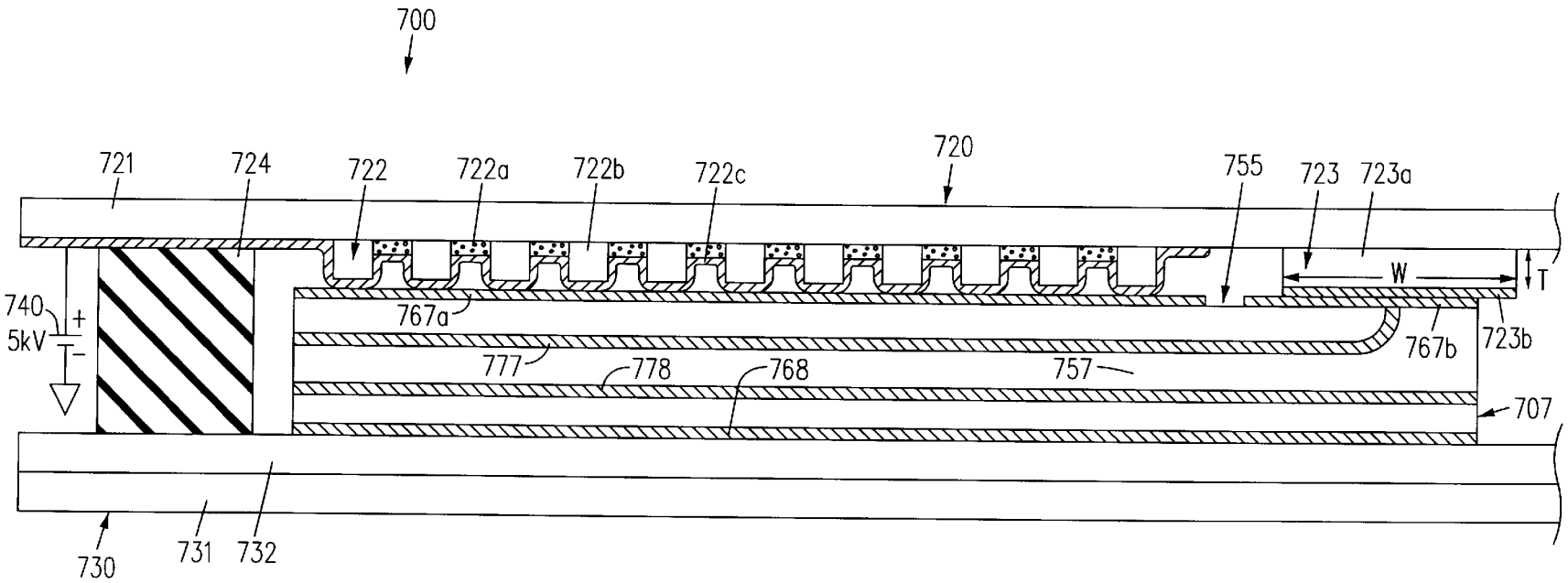
FIG. 8 is a cross sectional view of the flat panel display of FIG. 7 along section line 8—8 of FIG. 7.
Figure 9:
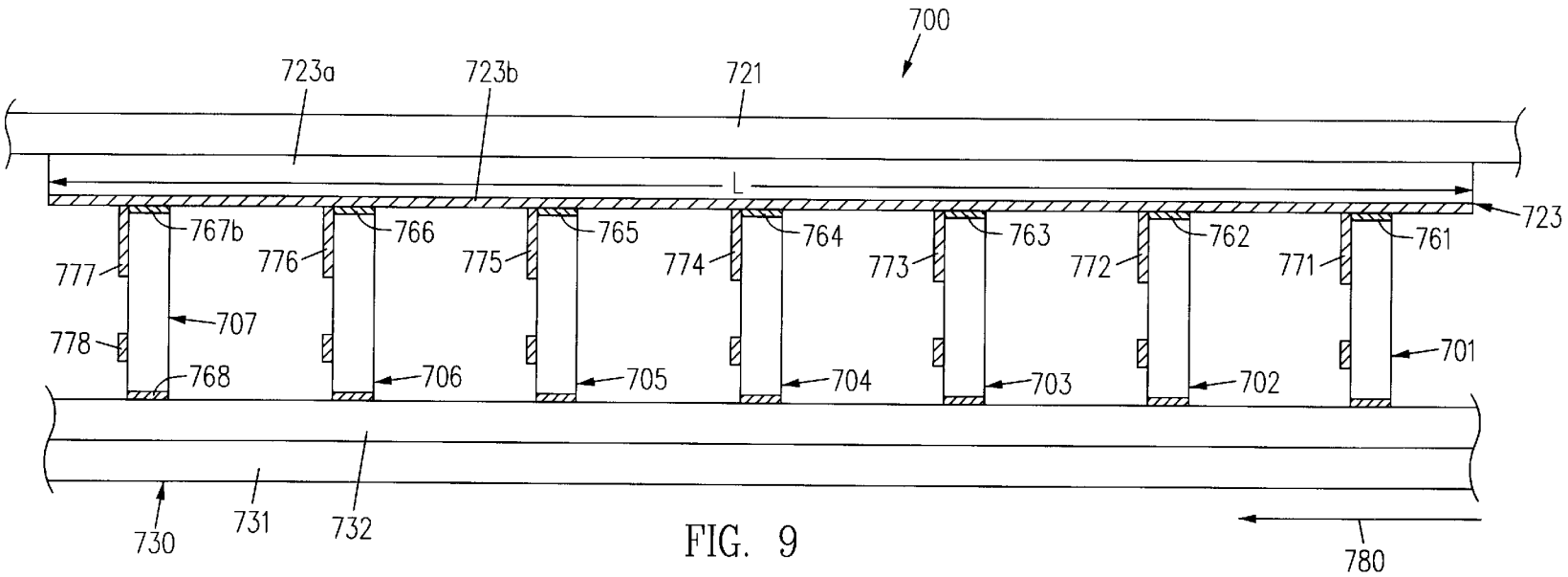
FIG. 9 is a cross sectional view of the flat panel display of FIG. 7 along section line 9—9 of FIG. 7.

FIG. 7 is a schematic representation of the upper surface of a flat panel display 700. FIG. 8 is a cross sectional view of flat panel display 700 along section line 8—8 of FIG. 7. FIG. 9 is a cross sectional view of flat panel display 700 along section line 9—9 of FIG. 7. Flat panel display 700 includes spacers 701–707, faceplate structure 720, backplate structure 730, common bus structure 723 and sidewall structure 724. Faceplate structure 720 includes insulating faceplate 721 and light emitting structure 722. Backplate structure 730 includes insulating backplate 731 and electron emitting structure 732.

In the described embodiment, each of spacers 701–707 is identical to spacer 601 (FIG. 6). As illustrated in FIG. 7, spacers 701–707 extend horizontally across light emitting structure 722 in parallel with the pixel rows of flat panel display 700. Light emitting structure 722 defines the viewing surface of flat panel display 700. Common bus structure 723 is laterally separated from this viewing surface. Sidewall structure 724 laterally surrounds the light emitting structure 722 and common bus structure 723.

As illustrated in FIG. 8, sidewall structure 724 extends between faceplate structure 720 and backplate structure 730. Light emitting structure 722 of faceplate structure 720 includes a light emissive material 722*a*, a matrix 722*b* and a conductive layer 722*c*. Conductive layer 722*c* extends outside the outer boundary of sidewall structure 724 and is connected to a power supply 740. Common bus structure 723 includes an insulating strip 723*a* and a conductive bus layer 723*b*. In one embodiment, insulating strip 723*a* is formed at the same time as matrix 722*b*, thereby assuring that insulating strip 723*a* and matrix 722*b* have substantially the same thickness. In a particular variation, insulating strip 723*a* and matrix 722*b* are formed from polyimide, and have a thickness T of approximately 2 mils. Insulating strip 723*a* further has a width W of approximately 50 to 100 mils. Conductive layers 722*c* and 723*b* can also be formed at the same time. The thicknesses of conductive layers 722*c* and 723*b* are negligible with respect to the thicknesses of insulating strip 723*a* and matrix 722*b*. Because insulating strip 723*a* and matrix 722*b* have approximately the same thickness, conductive layers 722*c* and 723*b* are located at the same distance from faceplate 721, thereby facilitating contact between conductive layers 722*c* and 723*b* and spacers 701–707.

Still referring to FIG. 8, spacer 707 includes body 757, edge electrodes 767*a*, 767*b*, and 768, face electrodes 777 and 778, and gap 755. Spacer 707 is connected between faceplate structure 720 and backplate structure 730 such that conductive layer 722*c*of light emitting structure 722 contacts edge electrode 767*a*, conductive bus layer 723*b* of common bus structure 723 contacts edge electrode 767*b*, and electron emitting structure 732 of backplate 730 contacts edge electrode 768. Gap 755 electrically isolates edge electrodes 767*a* and 767*b*. Face electrode 777 is electrically connected to edge electrode 767*b* as illustrated. Each of the remaining spacers 701–706 is connected in the same manner as spacer 707. Although not illustrated in FIG. 8, it is understood that the top portion of spacer 707 could be engaged with a spacer support structure on faceplate structure 720. Such a spacer support structure is not illustrated for purposes of clarity. However, such spacer support structures are described in more detail in Spindt U.S. patent application Ser. No. 08,188,855, filed Jan. 31, 1994, now U.S. Pat. No. 5,528,103; and Haven, U.S. patent application Ser. No. 08/343,074, filed Nov. 21, 1994, now U.S. Pat. No. 5,650,690, both of which are hereby incorporated by reference in their entirety.

As illustrated in FIG. 9, each of spacers 701–706 has a corresponding face electrode 771–776 which contacts a corresponding edge electrode 761–766 in the same manner previously described for spacer 707. Each of edge electrodes 761–766 contacts conductive bus layer 723*b* in the same manner as spacer 707. As a result, conductive bus layer 723*b* provides a common bus which connects face electrodes 771–777. In one variation, conductive bus structure 723 has a length L of approximately 8 inches.

If the rows of electron emitting elements of electron emitting structure 732 are fired in the direction indicated by arrow 780, spacer 701 will be the first one of spacers 701–707 to be exposed to conditions which could result in spacer charge build-up. However, the common connection of face electrodes 771–777 through conductive bus layer 723*b* increases the effective capacitance of spacer 701, thereby preventing rapid charge build-up on spacer 701. The charge buildup rate on spacers 702–707 is similarly reduced by the common connection of face electrodes 771–777 to conductive bus layer 723*b*.

Fourth Embodiment

Figure 10:
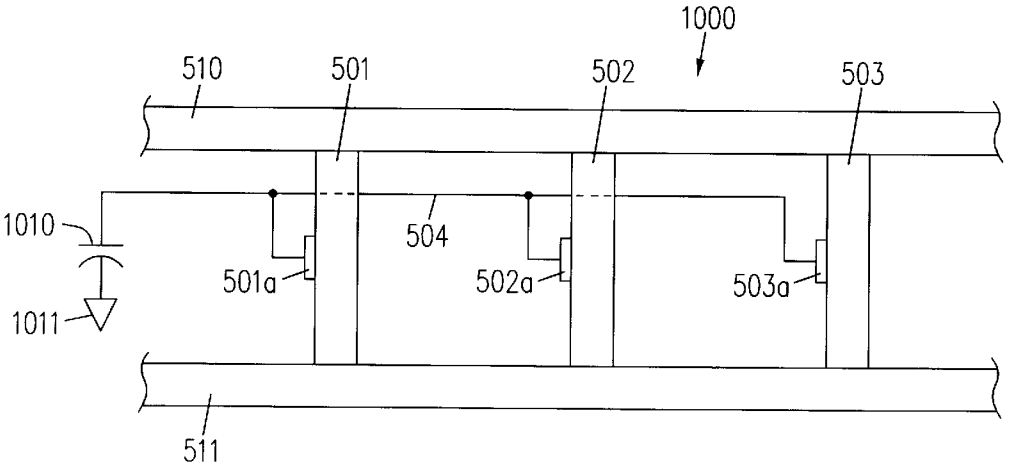
FIG. 10 is a schematic representation of a flat panel display having an external capacitor coupled to a common spacer bus in accordance with another embodiment of the present invention.

FIG. 10 is a schematic diagram of a flat panel display 1000 in accordance with another embodiment of the present invention. Like the third embodiment, the present embodiment can be used in combination with the previously described first and second embodiments, or independent of these previously described embodiments. Because the flat panel display 1000 illustrated in FIG. 10 is similar to the flat panel display 500 illustrated in FIG. 5, similar elements in FIGS. 5 and 10 are labeled with similar reference numbers. FIG. 10 additionally includes external capacitor 1010 which is connected between common bus 504 and ground 1011. Capacitor 1010 increases the effective capacitance of spacers 501–503, thereby further increasing the charging time constant associated with spacers 501–503 and preventing rapid charging of these spacers.

Figure 11:
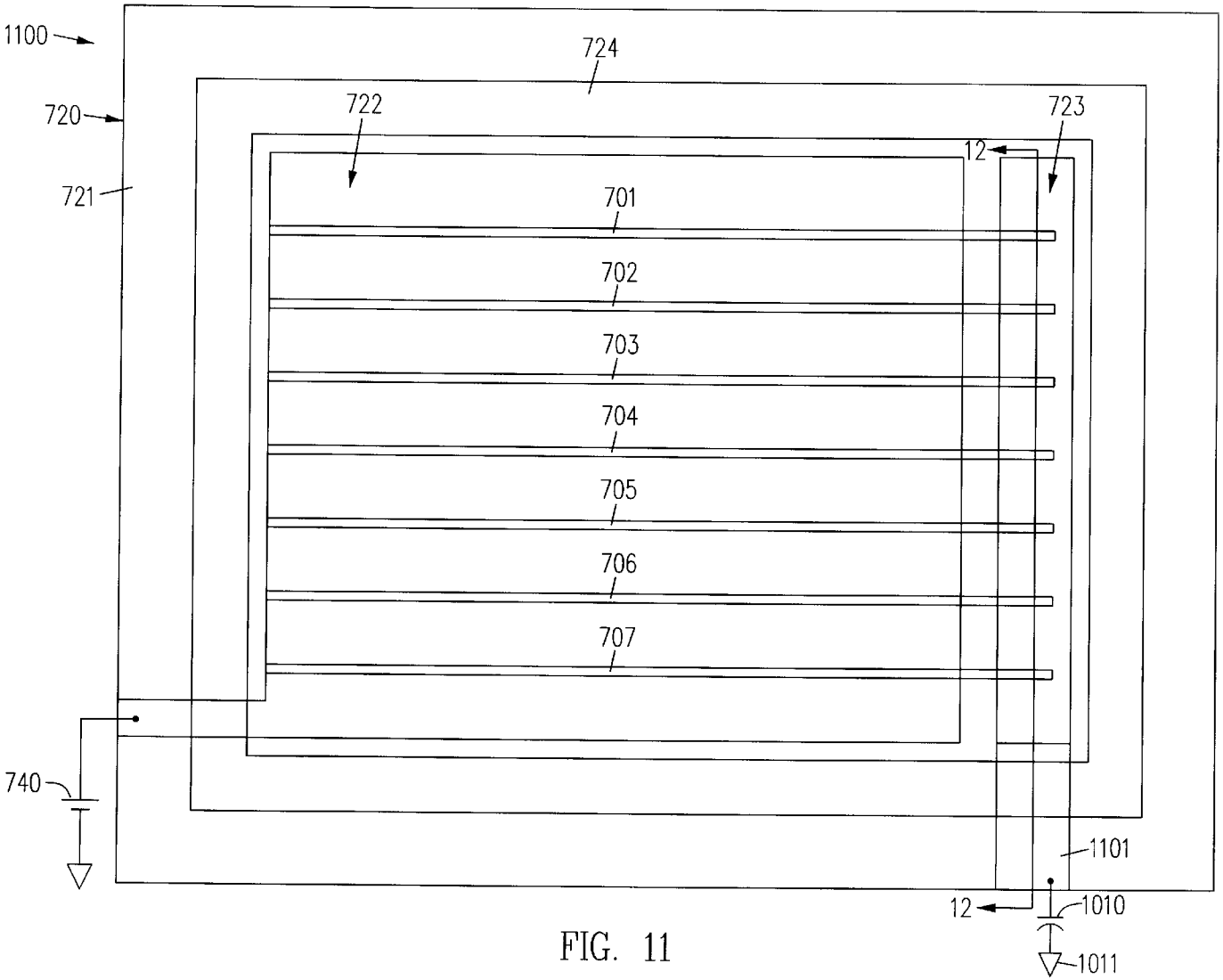
FIG. 11 is a schematic representation of the upper surface of a flat panel display having an external capacitor coupled to a common spacer bus.
Figure 12:
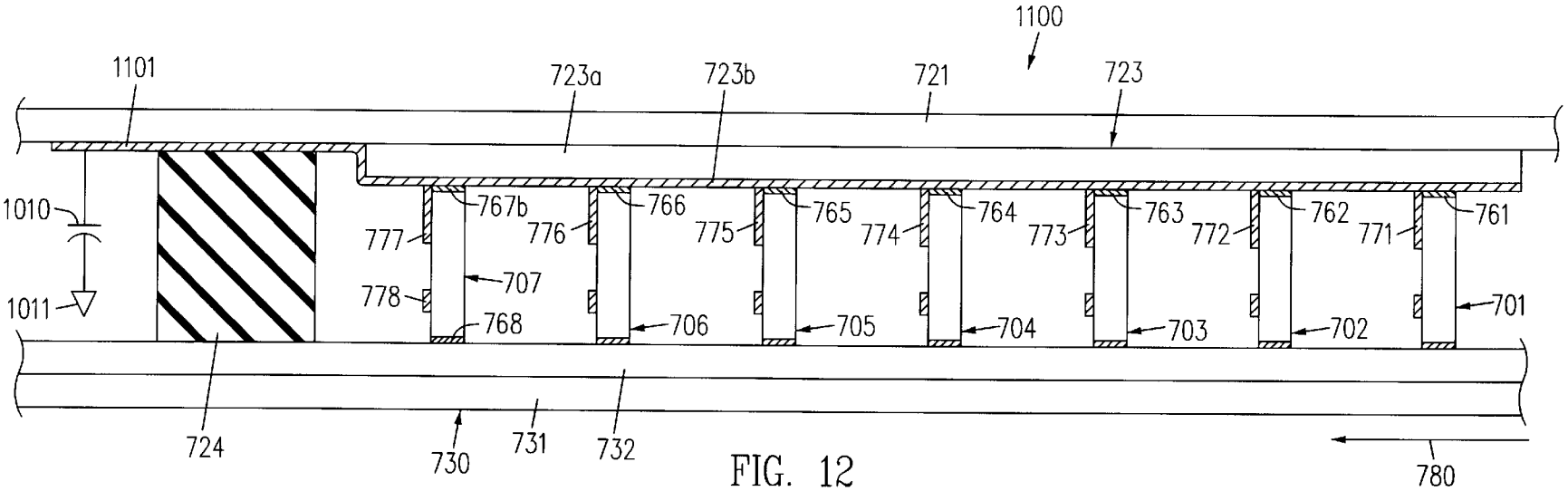
FIG. 12 is a cross sectional view of the flat panel display of FIG. 11 along section line 12—12 of FIG. 11.

FIG. 11 is a schematic representation of the upper surface of a flat panel display 1100 in accordance with the present embodiment. FIG. 12 is a cross sectional view of flat panel display 1100 along section line 12—12 of FIG. 11. Because flat panel display 1100 is similar to flat panel display 700 (FIGS. 7–9), similar elements in flat panel displays 700 and 1100 are labeled with similar reference numbers. In addition to the previously described elements of flat panel display 700, flat panel display 1100 additionally includes a common bus extension member 1101 which contacts the conductive bus layer 723*b* of common bus structure 723. In one variation, common bus extension member 1101 and conductive bus layer 723*b* are fabricated as a continuous element (See FIG. 12). Bus extension member 1101 extends along faceplate 721 to a location outside of the outer perimeter of sidewall structure 724. External capacitor 1010 is connected to the bus extension member 1101 at a point which is outside the outer perimeter of sidewall structure 724. In this manner, bused face electrodes 771–777 are connected to an external capacitor 1101. This increases the capacitance of spacers 701–707 and prevents fast charge build-up on these spacers.

Fifth Embodiment

Figure 13:
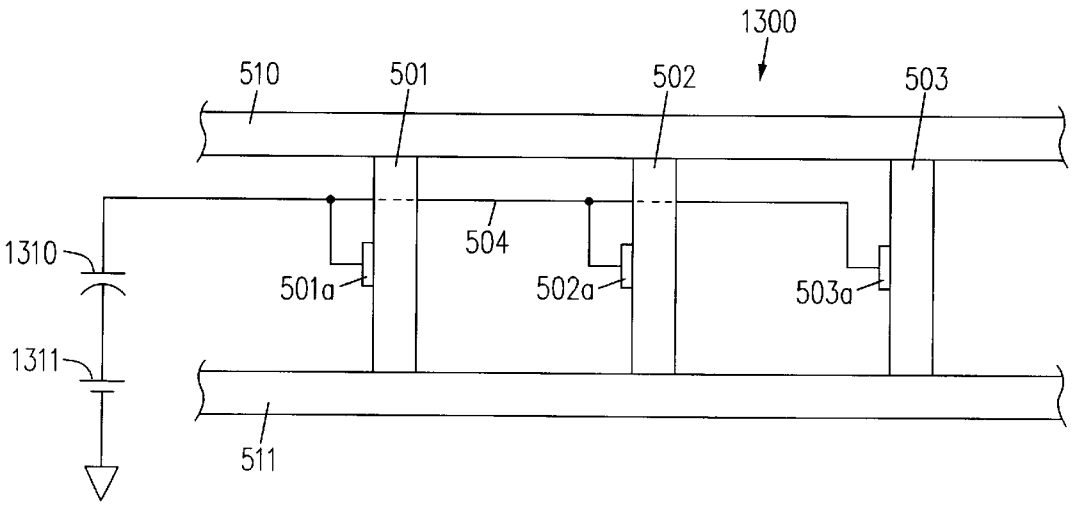
FIG. 13 is a schematic representation of a flat panel display having an internal capacitor coupled to a common spacer bus in accordance with yet another embodiment of the present invention.

FIG. 13 is a schematic diagram of a flat panel display 1300 in accordance with yet another embodiment of the present invention. Like the third and fourth embodiments, the present embodiment can be used in combination with the previously described first and second embodiments, or independent of these previously described embodiments. Because flat panel display 1300 is similar to flat panel display 500 (FIG. 5), similar elements in FIGS. 5 and 13 are labeled with similar reference numbers. FIG. 13 additionally includes a capacitor 1310 which is connected between common bus 504 and voltage supply 1311. Capacitor 1310 increases the effective capacitance of spacers 501–503, thereby further increasing the charging time constant associated with spacers 501–503 and preventing rapid charging of these spacers.

Figure 14:
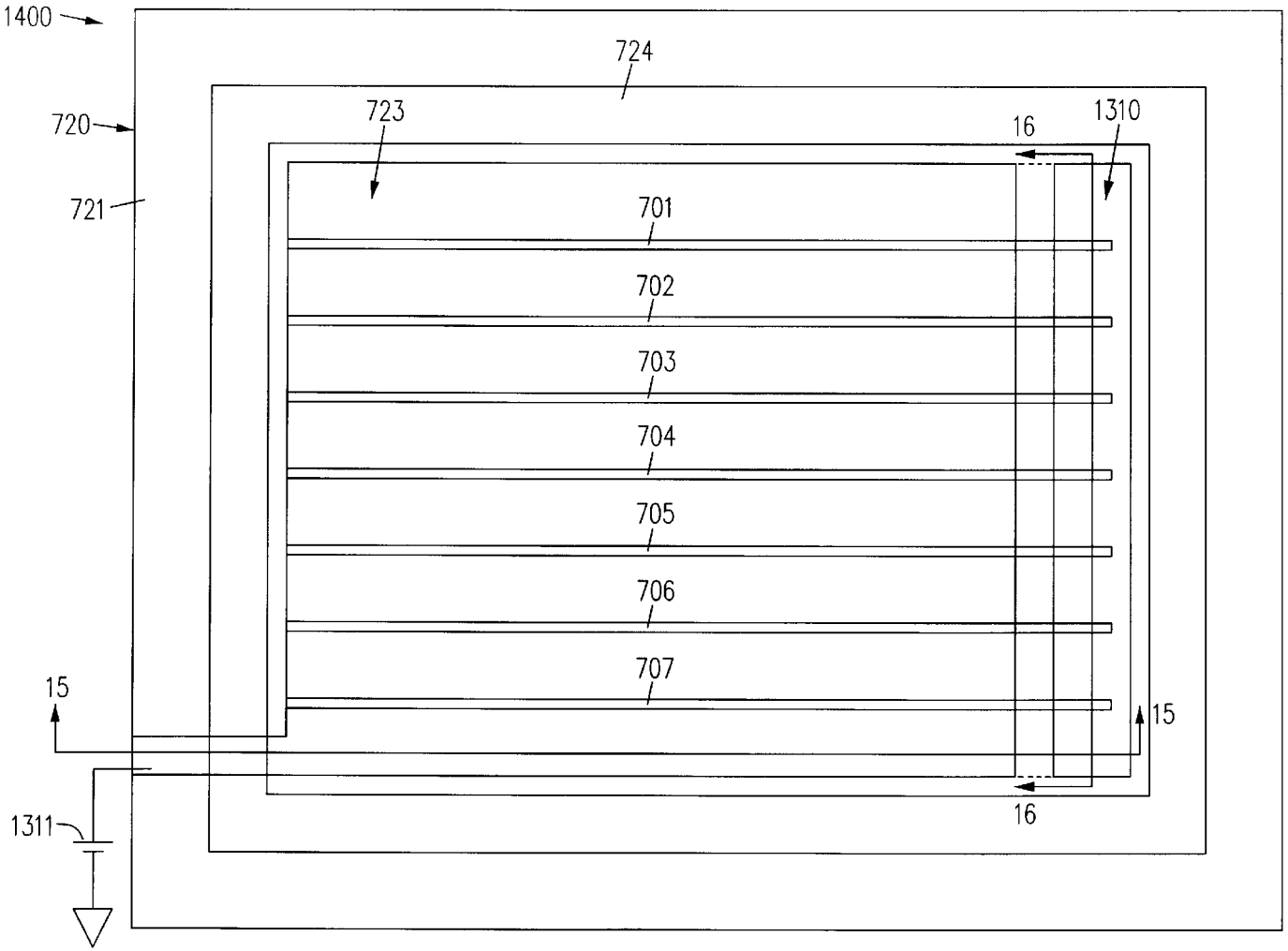
FIG. 14 is a schematic representation of the upper surface of a flat panel display having an internal capacitor coupled to a common spacer bus.
Figure 15:
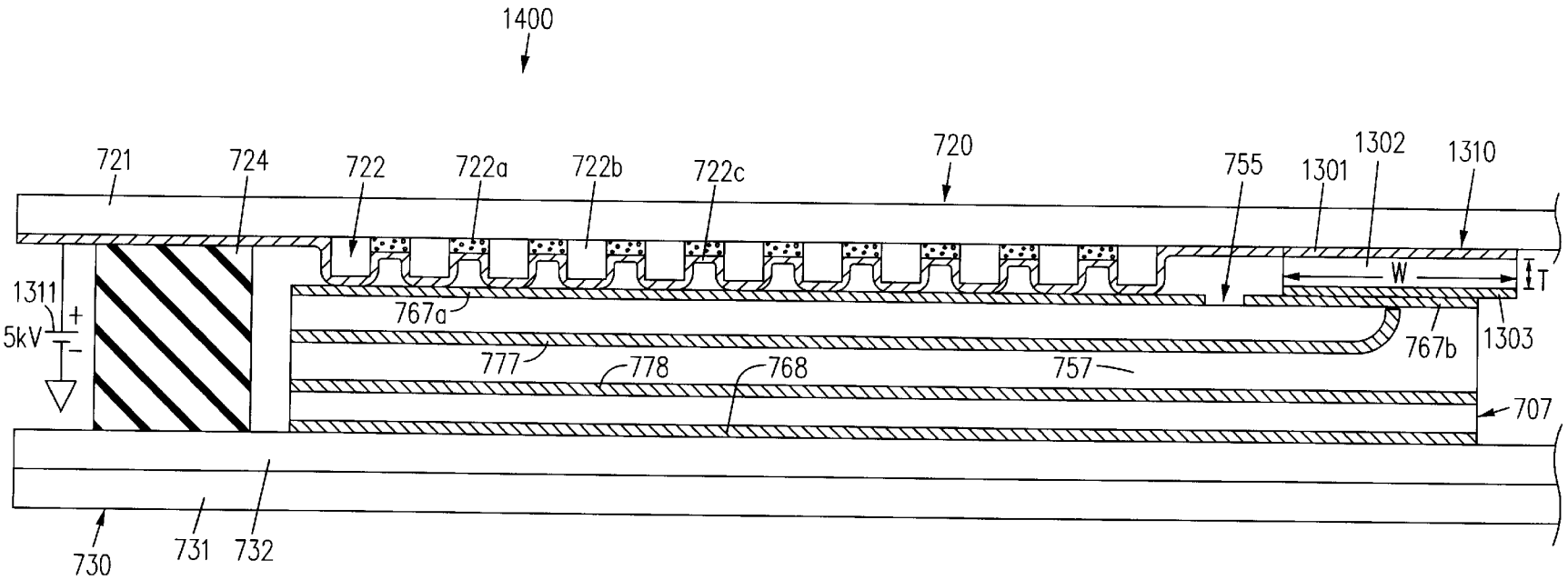
FIG. 15 is a cross sectional view of the flat panel display of FIG. 14 along section line 15—15 of FIG. 14.
Figure 16:
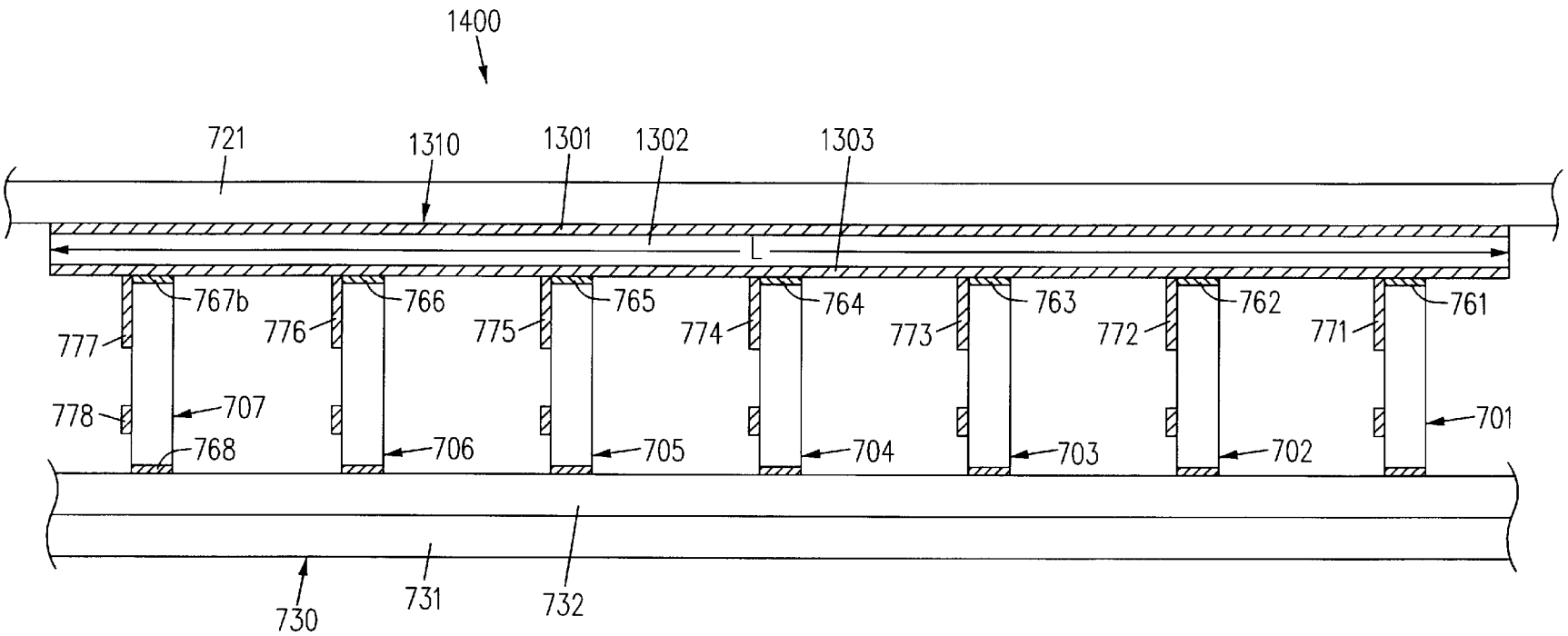
FIG. 16 is a cross sectional view of the flat panel display of FIG. 14 along section line 16—16 of FIG. 14.

FIG. 14 is a schematic representation of the upper surface of a flat panel display 1400 in accordance with the present embodiment. FIG. 15 is a cross sectional view along section line 15—15 of FIG. 14, and FIG. 16 is a cross sectional view along section line 16—16 of FIG. 14. Because flat panel display 1400 is similar to flat panel display 700 (FIGS. 7–9), similar elements are labeled with similar reference numbers.

Flat panel display 1400 includes a capacitor structure 1310 which is fabricated on the interior surface of faceplate 721. As illustrated in FIG. 14, capacitor structure 1310 is located outside of the viewing surface of display 1400 in a location similar to the location of common bus structure 723 (FIG. 7).

As illustrated in FIGS. 15 and 16, capacitor structure 1310 includes first conductive plate 1301, dielectric layer 1302 and second conductive plate 1303. In the illustrated embodiment, first conductive plate 1301 is continuous with conductive layer 722*c* of light emitting structure 722. That is, first conductive plate 1301 and conductive layer 722*c* are deposited at the same time to form a continuous layer of conductive material. Dielectric layer 1302 can be, for example, a layer of polyimide having a thickness T of approximately 2 mils, a width W of approximately 50 to 100 mils and a length L of approximately 8 inches. Second conductive plate 1303 is deposited on the lower surface of dielectric layer 1302. The combined thickness of plates 1301, 1303 and dielectric layer 1302 are selected to be equal to the combined thickness of matrix 722*b* and conductive layer 722*c* of light emitting structure 722. As a result, both capacitor structure 1310 and light emitting structure 722 make good electrical contact with spacers 701–707.

First and second conductive plates 1301 and 1303 and dielectric layer 1302 form a capacitor. The first conductive plate 1301 of this capacitor is connected to voltage supply 1311 through conductive layer 722*c* of light emitting structure 722 (FIG. 15). The second conductive plate 1303 of this capacitor is connected to face electrodes 771–777, such that face electrodes 771–777 extend in parallel from second conductive plate 1303. The capacitance of capacitor structure 1310 is determined by the thickness (T), cross sectional area (L×W), and dielectric constant of dielectric layer 1302. These parameters can be varied to create a capacitor structure 1310 having the desired capacitance. In the described embodiment, capacitor structure 1310 has a capacitance in the range of approximately 3 to 6 nanofarads.

In another variation of the present embodiment, the first conductive plate 1301 is not connected to conductive layer 722*c* of light emitting structure 722. Instead, first conductive plate 1301 is routed outside the outer perimeter of sidewall structure 724 (See, e.g., extension member 1101 of FIG. 11) and connected to a ground voltage supply.

Sixth Embodiment

Figure 17:
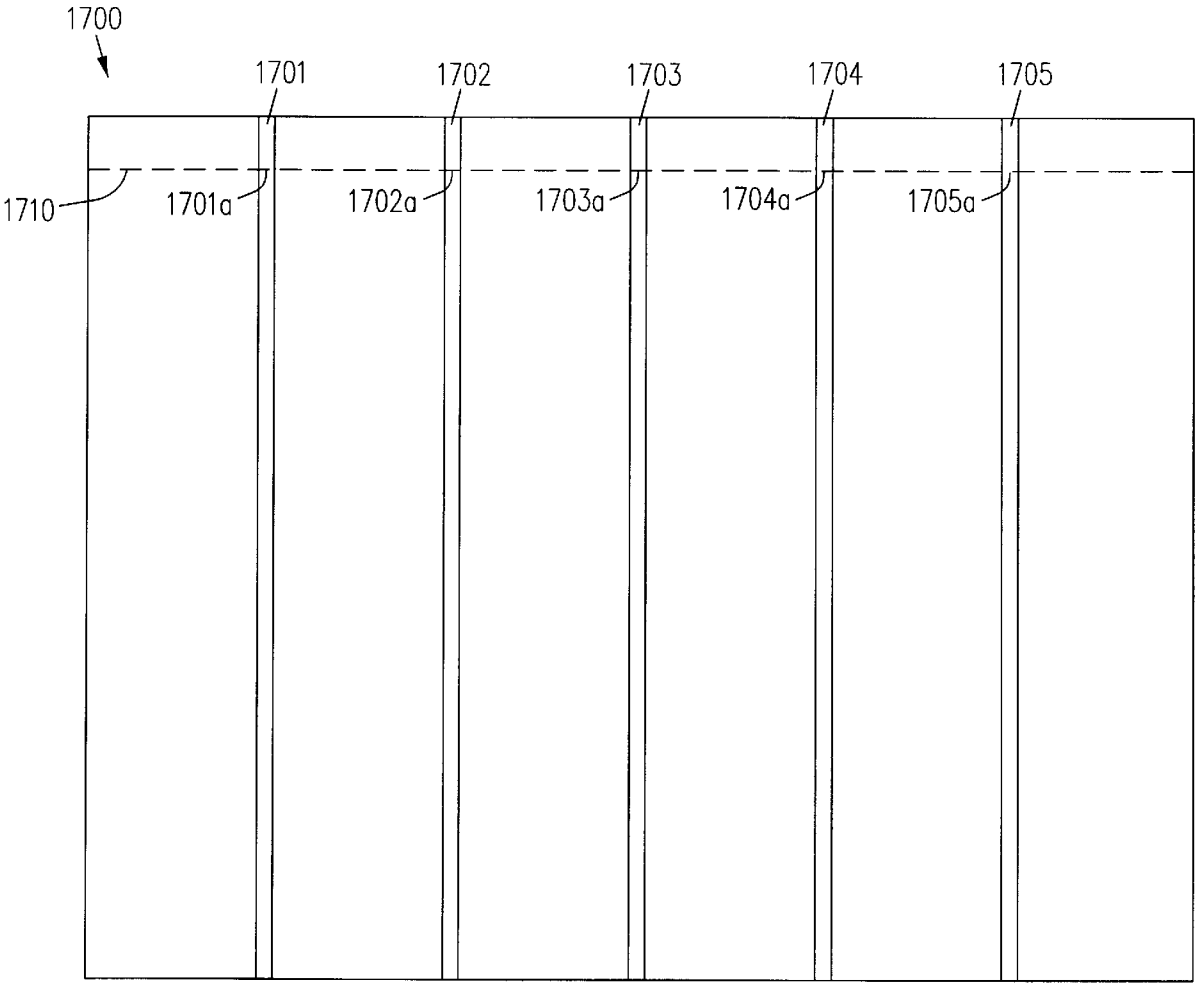
FIG. 17 is a schematic representation of the upper surface of a flat panel display having spacers located in parallel with pixel rows in accordance with another embodiment of the invention.

FIG. 17 is a schematic representation of the upper surface of a flat panel display 1700 in accordance with another embodiment of the present invention. Flat panel display 1700 includes a plurality of spacers 1701–1705 which are disposed perpendicular to (as opposed to in parallel with) the pixel rows. Dashed line 1710 represents one of these pixel rows. As the pixel rows of flat panel display 1700 are activated, each of spacers 1701–1705 is charged at a location which is immediately adjacent to the activated pixel row. For example, when pixel row 1710 is activated, spacers 1701–1705 tend to charge at locations 1701*a*–1705*a*.

Figure 18:
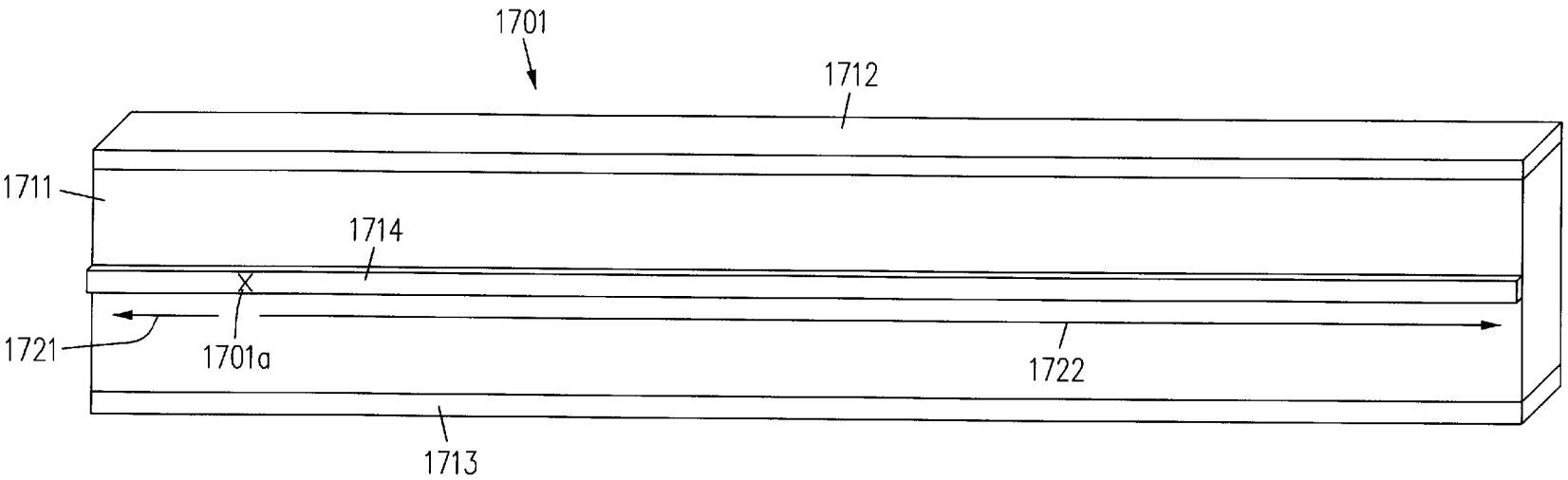
FIG. 18 is an isometric view of a spacer which can be used in the flat panel display of FIG. 17.

FIG. 18 is an isometric view of spacer 1701. Spacers 1702–1705 are identical to spacer 1701. Spacer 1701 includes spacer body 1711, edge electrodes 1712–1713 and face electrode 1714. The various elements of spacer 1701 are substantially identical to the elements of spacer 601, which were previously described in connection with FIG. 6. Face electrode 1714 is located approximately halfway up the height of spacer 1701 and extends along the length of spacer body 1711, substantially in parallel with edge electrodes 1712 and 1713. When a particular location along spacer 1701, such as location 1701*a*, is subjected to excessive charge, face electrode 1714 allows this charge to be distributed (and dissipated) along the length of spacer 1701 as indicated by arrows 1721 and 1722. Consequently, there is no excessive charge build-up along spacers 1701–1705 at locations adjacent to activated pixel rows.

Although the invention has been described in connection with several embodiments, it is understood that this invention is not limited to the embodiments disclosed, but is capable of various modifications which would be apparent to one of ordinary skill in the art. For example, common bus structure 723 and capacitor structure 1310 can be fabricated on the backplate as well as the faceplate. Thus, the invention is limited only by the following claims.

What is claimed is:

1. A method of displaying pixel information on a flat panel display comprising a faceplate structure, a backplate structure coupled to the faceplate structure, and a spacer situated between the faceplate and backplate structures, the display being partitioned into (a) a pair of spacer-adjacent regions adjacent to, and respectively on opposite sides of, the spacer and (b) a pair of spacer-charging regions respectively adjacent to, and further away from the spacer than, the spacer-adjacent regions, the spacer being charged by the spacer-charging regions when they are activated, the method comprising the steps of:

activating the spacer-adjacent regions during a frame of the pixel information; and subsequently activating the spacer-charging regions during the frame of pixel information.

2. A method as in claim 1 wherein the display is further partitioned into a spacer-neutral region adjacent to, and further away from the spacer than, one of the spacer-charging regions, the spacer not being significantly charged by the spacer-neutral region when it is activated, the method further including, prior to the step of activating the spacer-adjacent regions, the step of activating the spacer-neutral region during the frame of pixel information.

3. A method as in claim 2 wherein the display is further partitioned into a further spacer-neutral region adjacent to, and further away from the spacer than, the other of the spacer-charging regions, the spacer not being significantly charged by the further spacer-neutral region when it is activated, the method further including, subsequent to the step of activating the spacer-charging regions, the step of activating the further spacer-neutral region during the frame of pixel information.

4. A method as in claim 3 wherein each of the spacer-adjacent, spacer-charging, and spacer-neutral regions comprises at least one row of pixels.

5. A method as in claim 4 wherein each of the spacer-charging and spacer-neutral regions comprises multiple rows of pixels.

6. A method as in claim 5 wherein the rows of pixels in each spacer-adjacent, spacer-charging, or spacer-neutral region having multiple rows of pixels are sequentially activated within that region.

7. A method as in claim 4 wherein the faceplate and backplate structures respectively comprise an electron emitting structure and a light emitting structure separated from each other, each row of pixels in each spacer-charging region being separated from the spacer by an average of 0.5–1.5 of the average distance separating the electron emitting and light emitting structures.

8. A method as in claim 2 wherein each of the spacer-adjacent, spacer-charging, and spacer-neutral regions comprises at least one row of pixels.

9. A method as in claim 8 wherein each of the spacer-charging and spacer-neutral regions comprises multiple rows of pixels.

10. A method as in claim 9 wherein the rows of pixels in each spacer-adjacent, spacer-charging, or spacer-neutral region having multiple rows of pixels are sequentially activated within that region.

11. A method as in claim 8 wherein the faceplate and backplate structures respectively comprise an electron emitting structure and a light emitting structure separated from each other, each row of pixels in each spacer-charging region being separated from the spacer by an average of 0.5–1.5 of the average distance separating the electron emitting and light emitting structures.

12. A method as in claim 1 wherein the display is a flat panel cathode ray tube display.

13. A method as in claim 1 wherein each of the spacer-adjacent and spacer-charging regions comprises at least one row of pixels.

14. A method as in claim 13 wherein each of the spacer-charging regions comprises multiple rows of pixels.

15. A method as in claim 14 wherein the rows of pixels in each spacer-adjacent or spacer-charging region having multiple rows of pixels are sequentially activated within that region.

16. A method as in claim 13 wherein the faceplate and backplate structures respectively comprise an electron emitting structure and a light emitting structure separated from each other, each row of pixels in each spacer-charging region being separated from the spacer by an average of 0.5–1.5 of the average distance separating the electron emitting and light emitting structures.

* * * * *